US007269864B2

(12) United States Patent
Brown et al.

(10) Patent No.: US 7,269,864 B2
(45) Date of Patent: Sep. 18, 2007

(54) MOUNTING SYSTEM FOR A FAUCET

(75) Inventors: Derek A. Brown, Avon, IN (US); Gerald J. McNerney, Carmel, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 449 days.

(21) Appl. No.: 10/918,939

(22) Filed: Aug. 16, 2004

(65) Prior Publication Data

US 2005/0022299 A1 Feb. 3, 2005

Related U.S. Application Data

(63) Continuation-in-part of application No. 10/411,432, filed on Apr. 10, 2003, now Pat. No. 7,003,818.

(60) Provisional application No. 60/373,277, filed on Apr. 17, 2002.

(51) Int. Cl.
*E03C 1/04* (2006.01)

(52) U.S. Cl. ..... 4/678

(58) Field of Classification Search ..... 4/675–678
See application file for complete search history.

(56) References Cited

U.S. PATENT DOCUMENTS

| | | | | |
|---|---|---|---|---|
| 1,592,353 | A | | 7/1926 | Gade |
| 2,173,064 | A | | 9/1939 | Judell |
| 2,591,991 | A | | 4/1952 | Young |
| 2,848,721 | A | | 8/1958 | Fredrickson |
| 3,010,474 | A | | 11/1961 | Moen |
| 3,012,251 | A | | 12/1961 | Fife |
| 3,035,276 | A | | 5/1962 | Hanson |
| 3,229,710 | A | | 1/1966 | Keller, III |
| 3,427,049 | A | | 2/1969 | Politz |
| 3,448,768 | A | | 6/1969 | Keller, III |
| 3,495,616 | A | | 2/1970 | Esposito |
| 3,561,485 | A | | 2/1971 | Kingler |
| 3,600,723 | A | | 8/1971 | Mongerson et al. |
| 3,609,774 | A | | 10/1971 | Allgood |
| 3,645,493 | A | | 2/1972 | Manoogian et al. |
| 3,790,966 | A | | 2/1974 | Keane |
| 3,796,380 | A | | 3/1974 | Johnson et al. |
| 3,807,453 | A | | 4/1974 | Dom et al. |
| 3,911,946 | A | | 10/1975 | Humpert et al. |
| 3,998,240 | A | | 12/1976 | Liautaud |
| 4,026,328 | A | | 5/1977 | Nelson |
| 4,064,900 | A | | 12/1977 | Schmitt |
| 4,186,761 | A | | 2/1980 | Guarnieri |
| RE30,559 | E | | 3/1981 | Schmitt |
| 4,290,445 | A | | 9/1981 | Turner |
| 4,328,830 | A | | 5/1982 | Greer |
| 4,337,795 | A | | 7/1982 | Argyris et al. |
| 4,356,574 | A | * | 11/1982 | Johnson ..... 4/676 |

(Continued)

FOREIGN PATENT DOCUMENTS

| | | |
|---|---|---|
| CH | 245633 | 11/1947 |

(Continued)

*Primary Examiner*—Charles E. Phillips
(74) *Attorney, Agent, or Firm*—Baker & Daniels LLP

(57) ABSTRACT

A faucet assembly including a mounting base and a faucet body housing. A coupler releasably couples the faucet body housing to the mounting base.

27 Claims, 8 Drawing Sheets

U.S. PATENT DOCUMENTS

| | | | | |
|---|---|---|---|---|
| 4,387,738 | A | | 6/1983 | Bisonaya et al. |
| 4,446,885 | A | | 5/1984 | Nolden |
| 4,458,839 | A | | 7/1984 | MacDonald |
| 4,513,769 | A | | 4/1985 | Purcell |
| 4,552,171 | A | | 11/1985 | Farrell et al. |
| 4,635,673 | A | | 1/1987 | Gerdes |
| 4,649,958 | A | | 3/1987 | Purcell |
| 4,671,316 | A | | 6/1987 | Botnick |
| 4,678,002 | A | | 7/1987 | Valley |
| 4,700,928 | A | | 10/1987 | Marty |
| 4,706,702 | A | | 11/1987 | Grasseschi |
| 4,760,861 | A | | 8/1988 | Botnick |
| 4,762,143 | A | | 8/1988 | Botnick |
| 4,762,273 | A | | 8/1988 | Gregory et al. |
| 4,771,485 | A | | 9/1988 | Traylor |
| 4,827,538 | A | | 5/1989 | Heimann et al. |
| 4,848,395 | A | | 7/1989 | Krippendorf |
| 4,852,192 | A | | 8/1989 | Viegener |
| 4,856,121 | A | | 8/1989 | Traylor |
| 4,903,725 | A | | 2/1990 | Ko |
| 4,911,335 | A | | 3/1990 | Stofle et al. |
| 4,998,555 | A | | 3/1991 | Barhydt, Sr. et al. |
| 5,010,922 | A | | 4/1991 | Agresta |
| 5,020,569 | A | | 6/1991 | Agresta |
| 5,027,851 | A | | 7/1991 | Drees et al. |
| 5,073,991 | A | | 12/1991 | Marty |
| 5,090,062 | A | | 2/1992 | Hochstrasser |
| 5,095,554 | A | | 3/1992 | Gloor |
| 5,127,427 | A | | 7/1992 | Kajpust et al. |
| 5,127,438 | A | | 7/1992 | Williams |
| 5,131,428 | A | | 7/1992 | Bory |
| 5,148,832 | A | | 9/1992 | Lin |
| 5,165,121 | A | | 11/1992 | McTargett et al. |
| 5,232,008 | A | | 8/1993 | Jeffress et al. |
| 5,275,199 | A | | 1/1994 | Howell |
| 5,349,987 | A | | 9/1994 | Shieh |
| 5,361,431 | A | | 11/1994 | Freier et al. |
| 5,375,272 | A | | 12/1994 | Mikol |
| 5,388,287 | A | | 2/1995 | Tischler et al. |
| 5,465,749 | A | | 11/1995 | Sauter et al. |
| 5,467,799 | A | | 11/1995 | Buccicone et al. |
| 5,518,016 | A | | 5/1996 | Sharwark |
| 5,535,776 | A | | 7/1996 | Kingman |
| 5,558,128 | A | | 9/1996 | Pawelzik et al. |
| 5,566,707 | A | | 10/1996 | Ching et al. |
| 5,642,755 | A | | 7/1997 | Mark et al. |
| 5,660,203 | A | | 8/1997 | Gnauert et al. |
| 5,669,417 | A | | 9/1997 | Lain-Jie |
| 5,685,341 | A | | 11/1997 | Chrysler et al. |
| 5,687,952 | A | | 11/1997 | Arnold et al. |
| 5,725,008 | A | | 3/1998 | Johnson |
| 5,746,244 | A | * | 5/1998 | Woolley et al. ..... 137/359 |
| 5,758,688 | A | | 6/1998 | Hamanaka et al. |
| 5,797,151 | A | | 8/1998 | Ko |
| 5,803,120 | A | | 9/1998 | Bertoli |
| 5,813,431 | A | | 9/1998 | Cool et al. |
| 5,822,811 | A | | 10/1998 | Ko |
| 5,845,345 | A | | 12/1998 | Ko |
| 5,865,211 | A | | 2/1999 | Thomas |
| 5,865,473 | A | | 2/1999 | Semchuck et al. |
| 5,884,662 | A | | 3/1999 | Ko |
| 5,894,613 | A | | 4/1999 | Fenn |
| 5,918,855 | A | | 7/1999 | Hamanaka et al. |
| 5,924,451 | A | | 7/1999 | Kuo |
| 5,946,746 | A | | 9/1999 | Bloom |
| 5,950,663 | A | | 9/1999 | Bloomfield |
| 5,960,490 | A | | 10/1999 | Pitsch |
| 5,979,489 | A | | 11/1999 | Pitsch |
| 5,983,917 | A | | 11/1999 | Thomas |
| 6,023,796 | A | | 2/2000 | Pitsch |
| 6,062,251 | A | | 5/2000 | Pitsch |
| 6,073,972 | A | | 6/2000 | Rivera |
| 6,082,407 | A | | 7/2000 | Paterson et al. |
| 6,085,784 | A | | 7/2000 | Bloom et al. |
| 6,123,106 | A | | 9/2000 | Benstead |
| 6,138,296 | A | | 10/2000 | Baker |
| 6,161,230 | A | | 12/2000 | Pitsch |
| 6,170,098 | B1 | | 1/2001 | Pitsch |
| 6,189,569 | B1 | | 2/2001 | Calhoun |
| 6,195,818 | B1 | | 3/2001 | Rodstein et al. |
| 6,202,686 | B1 | | 3/2001 | Pitsch et al. |
| 6,202,980 | B1 | | 3/2001 | Vincent et al. |
| 6,209,153 | B1 | | 4/2001 | Segien, Jr. |
| 6,220,278 | B1 | | 4/2001 | Sauter et al. |
| 6,220,279 | B1 | | 4/2001 | Segien |
| 6,256,810 | B1 | | 7/2001 | Baker |
| 6,267,136 | B1 | | 7/2001 | Johnson |
| 6,273,138 | B1 | | 8/2001 | Yoney |
| 6,273,394 | B1 | | 8/2001 | Vincent et al. |
| 6,301,728 | B1 | | 10/2001 | Pilatowicz et al. |
| 6,302,131 | B1 | | 10/2001 | Pitsch |
| 6,314,593 | B1 | | 11/2001 | Mantel |
| 6,328,059 | B1 | | 12/2001 | Testori et al. |
| 6,334,226 | B1 | | 1/2002 | Tokunaga et al. |
| 6,360,770 | B1 | | 3/2002 | Buchner et al. |
| 6,360,774 | B1 | | 3/2002 | Becker et al. |
| 6,370,712 | B1 | | 4/2002 | Burns et al. |
| 6,378,912 | B1 | | 4/2002 | Condon et al. |
| 6,385,798 | B1 | | 5/2002 | Burns et al. |
| 6,405,749 | B1 | | 6/2002 | Bloom et al. |
| 6,422,520 | B1 | | 7/2002 | Hand |
| 6,434,765 | B1 | | 8/2002 | Burns et al. |
| 6,438,771 | B1 | | 8/2002 | Donath, Jr. et al. |
| 6,457,191 | B2 | | 10/2002 | Brandebusemeyer et al. |
| 6,484,330 | B2 | | 11/2002 | Gray et al. |
| 6,491,058 | B1 | | 12/2002 | Wang |
| 6,571,407 | B1 | | 6/2003 | Skarie |
| 6,619,320 | B2 | | 9/2003 | Parsons |
| 6,631,730 | B1 | | 10/2003 | Bloom et al. |
| 6,684,906 | B2 | | 2/2004 | Burns et al. |
| 6,718,568 | B1 | | 4/2004 | Hensley |
| 6,725,472 | B2 | | 4/2004 | Gray et al. |
| 6,757,921 | B2 | | 7/2004 | Esche |
| 6,807,692 | B2 | | 10/2004 | Tsutsui et al. |
| 6,868,564 | B2 | | 3/2005 | Ginter et al. |
| 6,874,527 | B2 | | 4/2005 | Meeder |
| 6,912,742 | B1 | | 7/2005 | Wang |
| 6,918,400 | B2 | | 7/2005 | Buchner et al. |
| 7,055,545 | B2 | | 6/2006 | Mascari et al. |
| 2001/0011389 | A1 | | 8/2001 | Phillips-Liebich et al. |
| 2001/0044955 | A1 | | 11/2001 | Brandebusemeyer |
| 2002/0083520 | A1 | | 7/2002 | Osborne-Kirby |
| 2002/0124309 | A1 | | 9/2002 | Donath, Jr. et al. |
| 2002/0185182 | A1 | | 12/2002 | Wang |
| 2002/0189674 | A1 | | 12/2002 | Meeder |
| 2003/0204906 | A1 | | 11/2003 | Tsutsui et al. |
| 2003/0221254 | A1 | | 12/2003 | McNerney et al. |
| 2004/0034924 | A1 | | 2/2004 | Underbrink et al. |
| 2004/0060109 | A1 | | 4/2004 | Hensley |
| 2004/0094202 | A1 | | 5/2004 | Kawolics et al. |
| 2004/0123910 | A1 | | 7/2004 | Yardley |
| 2004/0143900 | A1 | | 7/2004 | Nelson et al. |
| 2004/0154673 | A1 | | 8/2004 | Mascari et al. |
| 2004/0179351 | A1 | | 9/2004 | Patterson |
| 2004/0200987 | A1 | | 10/2004 | Houghton |
| 2004/0221899 | A1 | | 11/2004 | Parsons et al. |
| 2005/0022299 | A1 | | 2/2005 | Brown et al. |
| 2005/0199843 | A1 | | 9/2005 | Jost et al. |
| 2005/0242198 | A1 | | 11/2005 | Kempf et al. |
| 2005/0242199 | A1 | | 11/2005 | Kempf et al. |

2005/0251907 A1 11/2005 Mintz et al.

FOREIGN PATENT DOCUMENTS

| | | |
|---|---|---|
| CH | 275914 | 6/1951 |
| CN | 1278584 | 1/2001 |
| CN | 1278585 | 1/2001 |
| CN | 1278586 | 1/2001 |
| CN | 1278588 | 1/2001 |
| DE | 100 22 350 A1 | 11/2001 |
| EP | 0808952 B1 | 9/2003 |
| GB | 371616 | 5/1931 |
| WO | WO 2005/056937 | 6/2005 |
| WO | WO 2005/118966 | 12/2005 |

* cited by examiner

MOUNTING SYSTEM FOR A FAUCET

CROSS-REFERENCE TO RELATED APPLICATIONS

This application is a continuation-in-part of U.S. patent application Ser. No. 10/411,432, filed Apr. 10, 2003, now U.S. Pat. No. 7,003,818 which claims the benefit of U.S. Provisional Patent Application Ser. No. 60/373,277, filed Apr. 17, 2002, the disclosures of which are expressly incorporated by reference herein.

BACKGROUND AND SUMMARY OF THE INVENTION

The present invention relates to a mounting system for faucets in which the faucet may be mounted from the top of a mounting deck, such as a countertop or sink.

The installation of a faucet onto a mounting deck is often a difficult and time consuming task. At least some of the installation typically requires the installer to work in the cramped and dimly lit work area under the mounting deck. More particularly, faucets are typically attached to the mounting deck with threaded connections which must be made under and behind the sink basin where there is very little room to work.

As such, there is a need to provide a less cumbersome and complicated system of installing faucets or interchange different faucet styles, such as single handle faucets and two handle faucets, onto a mounting deck which can be done largely from the top of the countertop or sink. More particularly, a system is desired which would permit the installer to exchange different escutcheon styles and handle combinations quickly and easily without replacing the complete faucet assembly.

According to an illustrated embodiment of the present invention, the faucet assembly includes a mounting base configured to be coupled to a mounting deck. The mounting base includes first and second fluid conduits extending downwardly away from the mounting deck. A waterway is in fluid communication with a first and second fluid conduits of the mounting base. A housing is configured to be positioned above the waterway. A gasket is positioned above the mounting deck and is configured to engage the faucet body housing. A coupler releasably couples the faucet body housing to the mounting base, the coupler being configured to cause the faucet body housing to apply an adjustable downward force against the gasket.

According to a further illustrated embodiment of the present invention, a faucet assembly includes a mounting base configured to be coupled to a mounting deck. A faucet body housing is configured to be positioned above the mounting base. A securing member is supported by the mounting base and a housing bracket is supported by the faucet body housing. A coupler releasably couples the faucet body housing to the mounting base, the coupler including a cam bolt having an attachment portion configured to be received within the securing member and a frusto-conical portion configured to be received within the housing bracket. The frusto-conical portion is configured to cause the faucet body housing to move toward the mounting base as the cam bolt is moved axially in a direction from the housing bracket towards the securing member.

According to yet another illustrative embodiment of the present invention, a faucet assembly includes a mounting base configured to be coupled to a mounting deck and including first and second fluid conduits extending downwardly from the mounting deck. A waterway includes first and second fluid tubes in fluid communication with the first and second fluid conduits of the mounting base. A faucet body housing is configured to be positioned above the waterway. A gasket is positioned above the mounting deck and is configured to engage the faucet body housing. A cam mechanism is configured to couple the faucet body housing to the mounting base, wherein operation of the cam mechanism moves the faucet body housing towards the mounting base.

In another illustrated embodiment of the present invention, a locking mechanism for a faucet assembly includes a securing member having an opening with internal threads. A first bracket includes an opening and is positioned in spaced relation to the securing member. A cam bolt includes an attachment portion having external threads configured to be threadably received within the opening of the securing member. The cam bolt further includes a frusto-conical portion configured to be received within the opening of the first bracket. Rotational movement of the attachment portion of the cam bolt causes axial movement of the frusto-conical portion of the cam bolt into engagement with the first bracket, thereby forcing the opening of the first bracket into substantial coaxial alignment with the opening of the securing member.

Additional features and advantages of the present invention will become apparent to those skilled in the art upon consideration of the following detailed description of the presently perceived best mode of carrying out the invention.

BRIEF DESCRIPTION OF THE DRAWINGS

The detailed description of the drawings particularly refers to the accompanying figures in which.

DETAILED DESCRIPTION OF THE DRAWINGS

Figure 1:
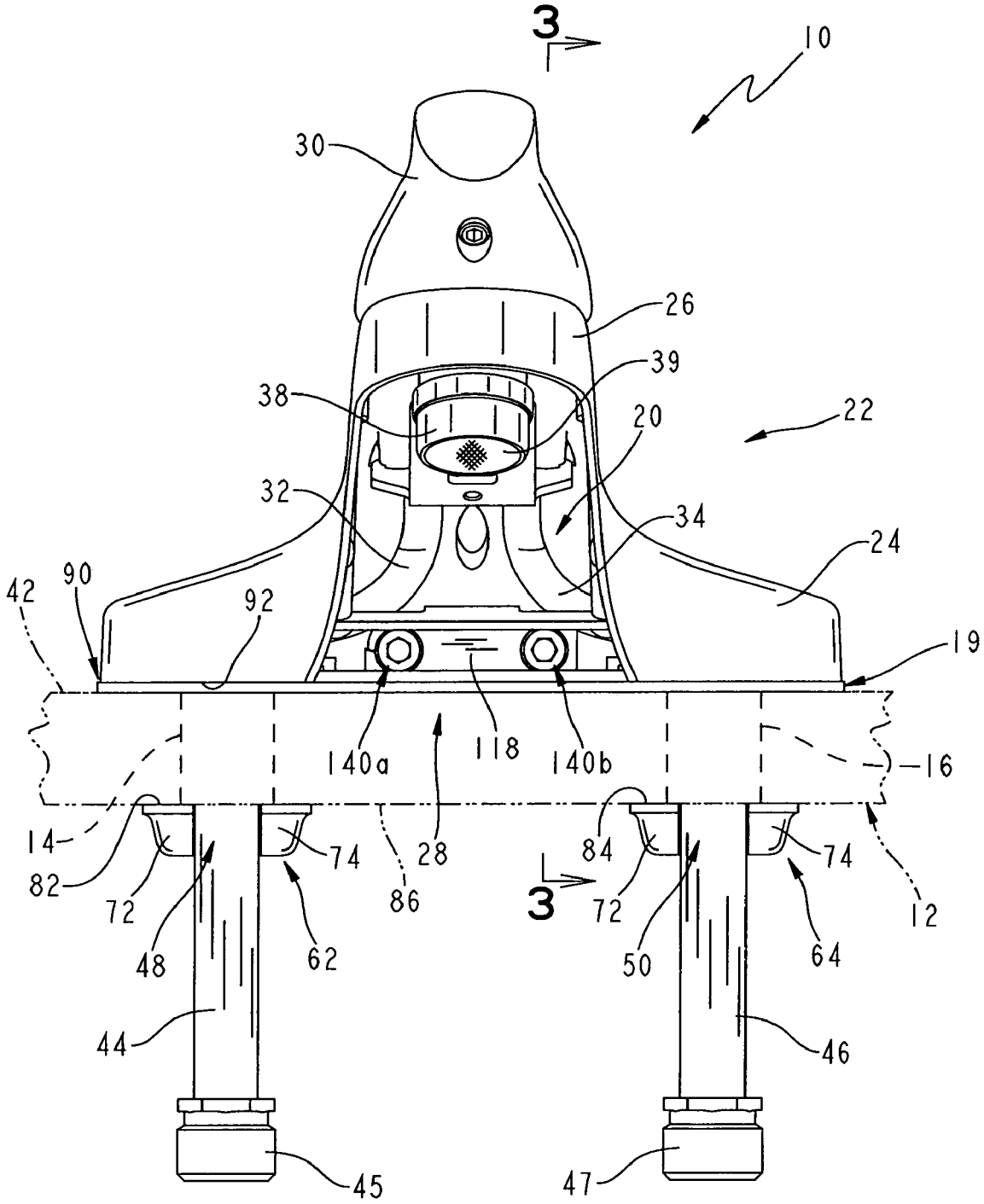
FIG. 1 is a front elevational view of the faucet assembly of the present invention coupled to a mounting deck.
Figure 2:
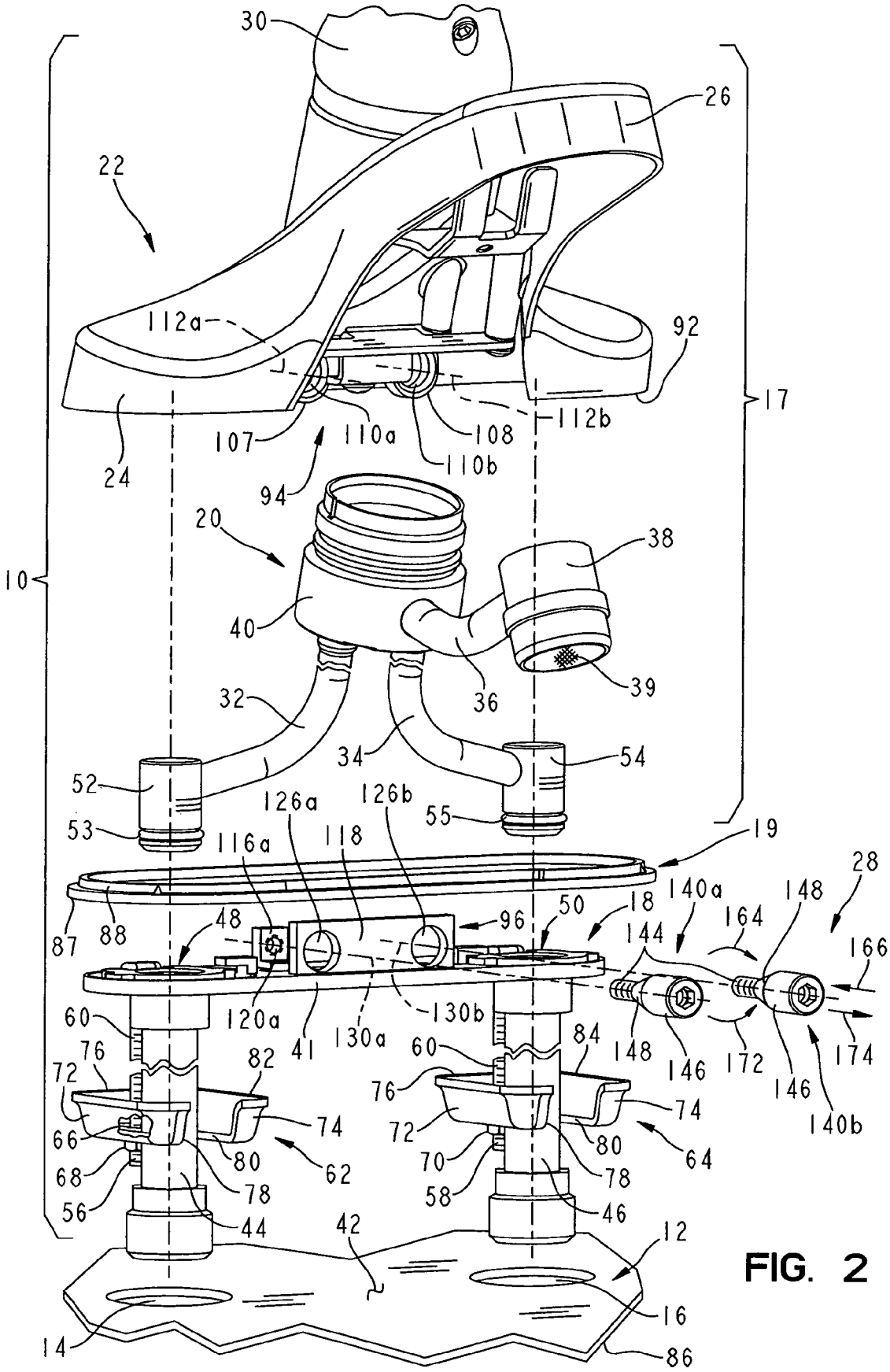
FIG. 2 is a partial exploded perspective view of the faucet assembly of FIG. 1.

Referring initially to FIGS. 1 and 2, a faucet assembly 10 is shown in conjunction with a mounting deck 12 on which it is mounted. The mounting deck 12 typically comprises a countertop or sink ledge and includes access openings 14, 16. The faucet assembly 10 includes an upper faucet assembly 17, a mounting base 18, and a gasket 19. The upper faucet assembly 17 includes a tubular waterway 20, and a faucet body housing or escutcheon 22 with a base 24 and a spout 26. A coupler 28 releasably couples the body housing 22 to the mounting base 18. An undercover plate (not shown) may be connected to cover the underside of the spout 26 and the waterway 20 for aesthetic purposes and to prevent access to water and dirt.

Figure 6:
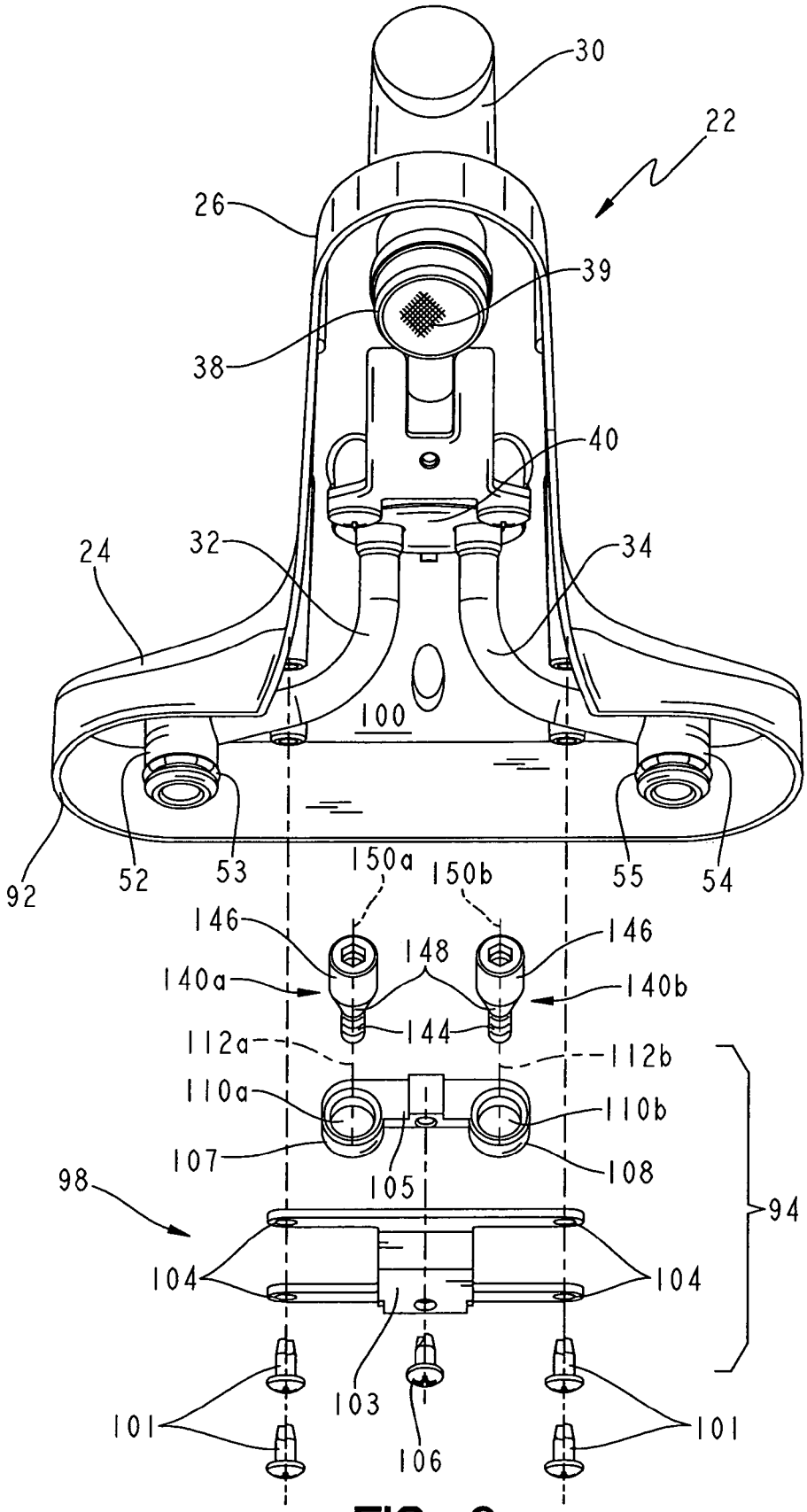
FIG. 6 is an exploded perspective view of the upper faucet assembly of FIG. 1.
Figure 7:
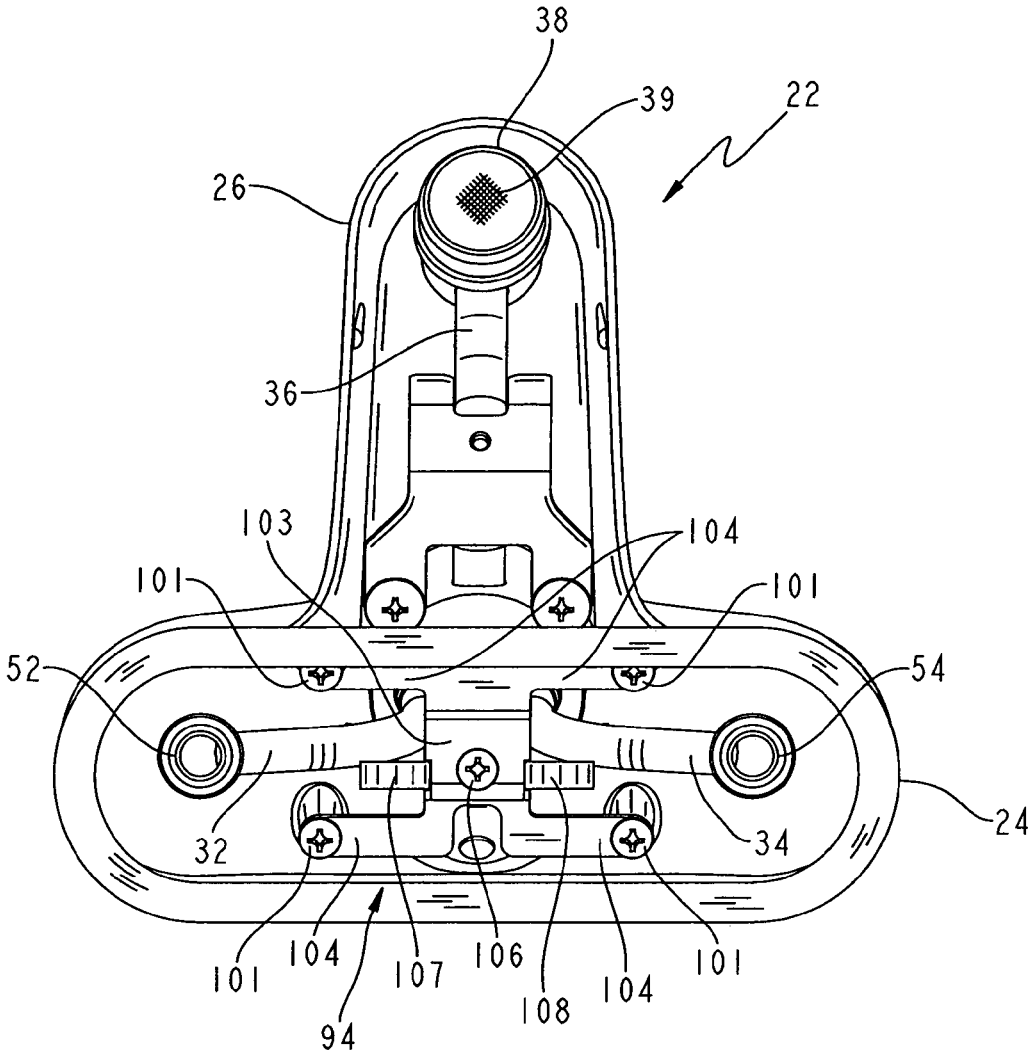
FIG. 7 is a bottom plan view of the upper faucet assembly.

In the embodiment illustrated in FIGS. 1 and 2, the faucet body housing 22 supports a single handle 30 operably coupled to the waterway 20. The waterway 20 includes first and second arms 32 and 34 and a spout leg 36 extending substantially perpendicular relative to the arms 32 and 34 to form a "T" shape. At the free end of the spout leg 36 is a discharge head 38 in which is disposed an aerator 39. The first and second arms 32 and 34 of the waterway 20 are fluidly coupled to a valve 40 that delivers water to the spout leg 36. The handle 30 is operably coupled to the valve 40 for controlling the flow of water from the arms 32 and 34 to the spout leg 36. The waterway 20 including the arms 32 and 34, the spout leg 36, and the valve 40 are disposed within the faucet body housing 22, as best shown in FIGS. 6 and 7.

While the illustrated embodiment shows a single handle 30 coupled to the valve 40, it should be appreciated the present invention may also be used with faucet assemblies including two handles operably coupled to a pair of valve assemblies. For example, the present invention may be used in connection with the two handle faucet detailed in U.S. patent application Ser. No. 10/411,432, filed Apr. 10, 2003, which is assigned to the assignee of the present invention and is expressly incorporated by reference herein.

With reference to FIGS. 2, and 3-5, the mounting base 18 includes a mounting plate 41 and is illustratively mounted from the top of the mounting deck 12 and sits on a top surface 42 thereof. It should be noted that the mounting base 18 may also be mounted from the underside of the mounting deck 12. Extending downwardly from the mounting base 18 are first and second inlet water conduits 44 and 46. Inlet water conduits 44 and 46 pass through access openings 14 and 16 in the mounting deck 12 and are connected, through conventional fittings 45 and 47, to conventional water supply tubes (not shown) under the mounting deck 12. Inlet water conduits 44 and 46 concentrically receive, at their top ends 48 and 50, adapter tubes 52 and 54 which extend downwardly from arms 32 and 34, respectively, of waterway 20. Seals 53 and 55, illustratively conventional rubber o-rings, are supported by the adapter tubes 52 and 54 and sealingly engage the inside surface of the inlet water conduits 44 and 46. Tubes 52 and 54 carry hot and cold water from inlet water conduits 44 and 46 to valve 40.

With further reference to FIGS. 1 and 2, first and second attachment posts 56 and 58 extend adjacent to and parallel with water conduits 44 and 46. The attachment posts 56 and 58 each include a plurality of external threads 60 and are configured to operably couple with first and second mounting base locking members 62 and 64, respectively. More particularly, each of the locking members 62 and 64 includes an opening 66 configured to receive the respective attachment post 56, 58 for axial sliding movement therealong (FIG. 2). A first securing nut 68 is threadably received on the threads 60 of the first attachment post 56 below the first mounting base locking member 62, and a second securing nut 70 is threadably received on the threads 60 of the second attachment post 58 below the second mounting base locking member 64. As such, the mounting base locking members 62 and 64 and securing nuts 68 and 70 are vertically movably mounted on threaded attachment posts 56 and 58 that are disposed parallel with adjacent water conduits 44 and 46, respectively.

The first and second mounting base locking members 62 and 64 are each substantially "U" shaped, with first and second arms 72 and 74 connected by a base 76. The first and second arms 72 and 74 include inwardly facing guide surfaces 78 and 80 which are configured to contact the water inlet conduits 44 and 46 and thereby prevent rotation of the mounting base locking members 62 and 64 as they are axially moved along the attachment posts 56 and 58.

To mount the faucet assembly 10 onto the mounting deck 12, water inlet conduits 44 and 46, and attachment posts 56 and 58 are inserted through the access openings 14 and 16, and the mounting base 18 is lowered until it rests on the mounting deck 12. The mounting base locking members 62 and 64 and the securing nuts 68 and 70 are received on the attachment posts 56 and 58 below the mounting deck 12.

When the mounting base 18 is on the mounting deck 12, the securing nuts 68 and 70 are rotated to cause the mounting base locking members 62 and 64 to move up or down on the threaded attachment posts 56 and 58. Clockwise rotation of the securing nuts 68 and 70 causes locking members 62 and 64 to move downwardly or away from the mounting deck 12 to an unlocked position. Counterclockwise rotation of the securing nuts 68 and 70 causes locking members 62 and 64 to move upwardly or toward mounting deck 12 to a locked position.

In the locked position, top surfaces 82 and 84 of the mounting base locking members 62 and 64 abut the bottom surface 86 of the mounting deck 12, thereby securing the mounting base 18 to the mounting deck 12.

To remove the faucet assembly 10 from the mounting deck 12, securing nuts 68 and 70 are rotated in a clockwise direction, moving the locking members 62 and 64 downwardly away from the bottom surface 86 of the mounting deck 12. Once the securing nuts 68 and 70 and the locking members 62 and 64 are removed from the attachment posts 56 and 58, the water inlet conduits 44 and 46, and attachment posts 56 and 58 are pulled up through the access openings 14 and 16 of the mounting deck 12.

With further reference to FIGS. 1 and 3-5, gasket 19 is illustratively received around the periphery of the mounting base 18 and is supported by the top surface 42 of the mounting deck 12. The gasket 19 includes a base 87 and an upwardly extending lip 88 supported by the base 87. The gasket 19 is configured to fill the gap 90 between a lower edge 92 of the body housing 22 and the top surface 42 of the mounting deck 12. Illustratively, the gasket 88 is formed from a resilient material, such as a low density polyethylene (LDPE).

Figure 8:
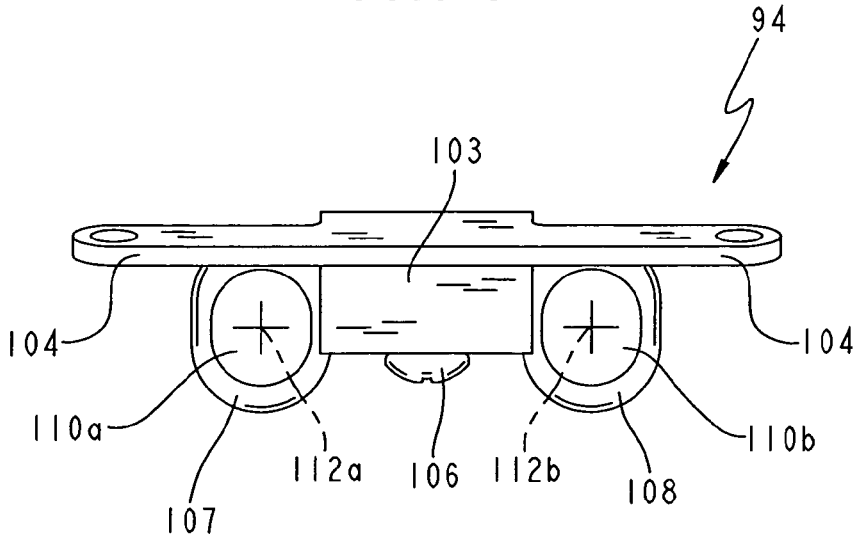
FIG. 8 is a perspective view of the housing bracket of FIG. 1.
Figure 9:
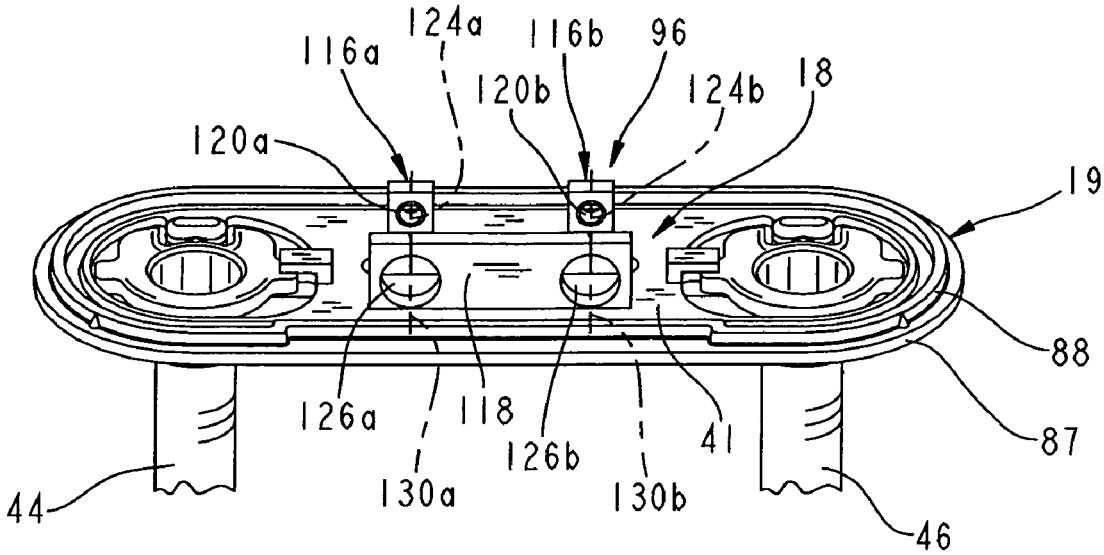
FIG. 9 is a perspective view of the mounting base, the mounting base bracket, and the gasket of FIG. 1.
Figure 10:
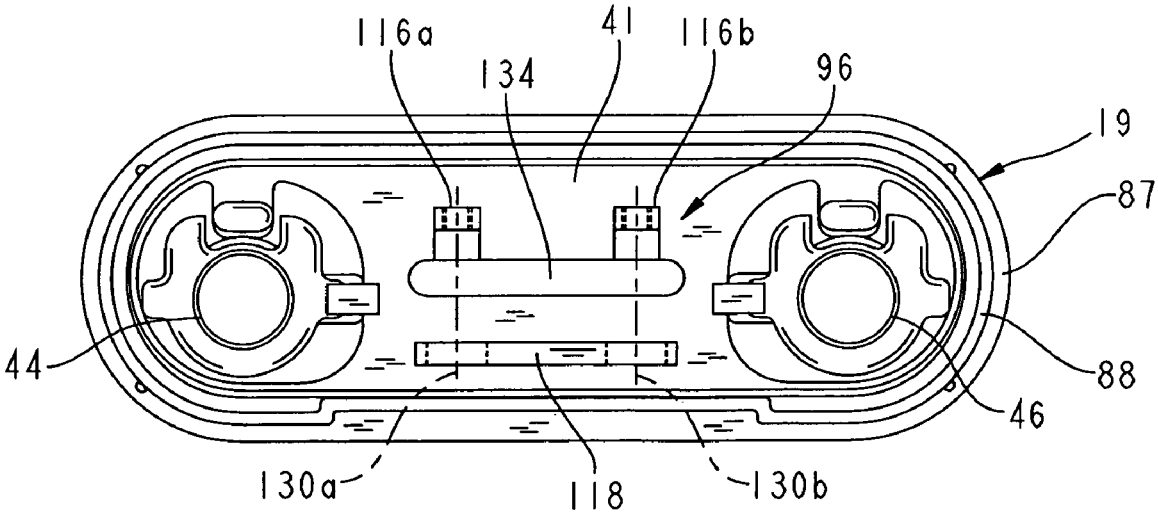
FIG. 10 is a top plan view of the mounting base, the mounting base bracket, and the gasket of FIG. 9.

The coupler 28 is configured to couple a housing bracket 94 supported by the faucet body housing 22 (FIGS. 6-8) to a base bracket 96 supported by the mounting base 18 (FIGS. 9 and 10). With further reference to FIGS. 6-8, the housing bracket 94 illustratively includes an attachment member 98 secured to a lower surface 100 of the faucet body housing 22 by a plurality of fasteners, illustratively screws 101. The attachment member 98 includes an "H" shaped body 102 including a central mount portion 103 and a plurality of arms 104 extending outwardly from the central mount portion 103. A receiving member 105 is coupled to the central mount portion 103 of the attachment member 98 by a fastener, such as a screw 106. The receiving member 105 extends downwardly from the body housing 22 and includes first and second loop portions 107 and 108 defining first and second openings, illustratively elongated slots 110*a* and 110*b* defining first and second axes 112*a* and 112*b*. As may be appreciated, the receiving member 105 may be integrally formed with the attachment member 98. Further, the receiving member 105 may be directly coupled to the body housing 22 without the use of attachment member 98.

While the illustrative embodiment housing bracket 94 is directly coupled to the body housing 22, it should be appreciated that the housing bracket 94 could also be coupled to the waterway 20 and, more particularly, to the valve 40. Moreover, any coupling, direct or indirect, between the housing bracket 94 and the body housing 22 is within the scope of the invention.

Referring further to FIGS. 9 and 10, the base bracket 96 includes first and second securing members 116*a* and 116*b* laterally spaced from an alignment member 118. The first and second securing members 116*a* and 116*b* extend upwardly from the mounting base 18 and include first and second openings 120*a* and 120*b*, each including internal threads 124*a* and 124*b*. The alignment member 118 extends upwardly from the mounting plate 41 and includes first and second openings 126*a* and 126*b* which are coaxially aligned with the openings 120*a* and 120*b* of the securing member 116 along first and second axes 130*a* and 130*b*. An elongated opening 134 is formed within the mounting plate 41 of the mounting base 18 intermediate the securing members 116*a* and 116*b* and the alignment member 118. The opening 134 is configured to receive the receiving member 105 of the housing bracket 94 as it is moved downwardly intermediate the securing members 116*a*, 116*b* and the alignment member 118 (FIGS. 6-8).

Referring again to FIGS. 1-5, the coupler 28 includes a first cam bolt 140*a* and a second cam bolt 140*b* extending parallel to the first cam bolt 140*a*. Each cam bolt 140*a* and 140*b* includes an attachment portion 144, an operating portion 146, and a cam portion 148 positioned intermediate the attachment portion 144 and the operating portion 146. Each cam bolt 140*a*, 140*b* extends along a longitudinally extending axis 150*a*, 150*b*0 (FIG. 6). As shown in the illustrative embodiment of FIGS. 3-5, the attachment portion 144 includes a cylindrical shaft 152 having a plurality of external threads 154. A recess 156 is formed in the end 158 of the operating portion 146 of each cam bolt 140*a*, 140*b* for receiving a tool (not shown) to assist in rotating the cam bolt 140*a*, 140*b* in a desired direction. The cam portion 148 illustratively comprises a frusto-conical portion 160 including an inclined outer surface 162 which is configured to engage the loop portion 107, 108 of the housing bracket 94.

Figure 3:
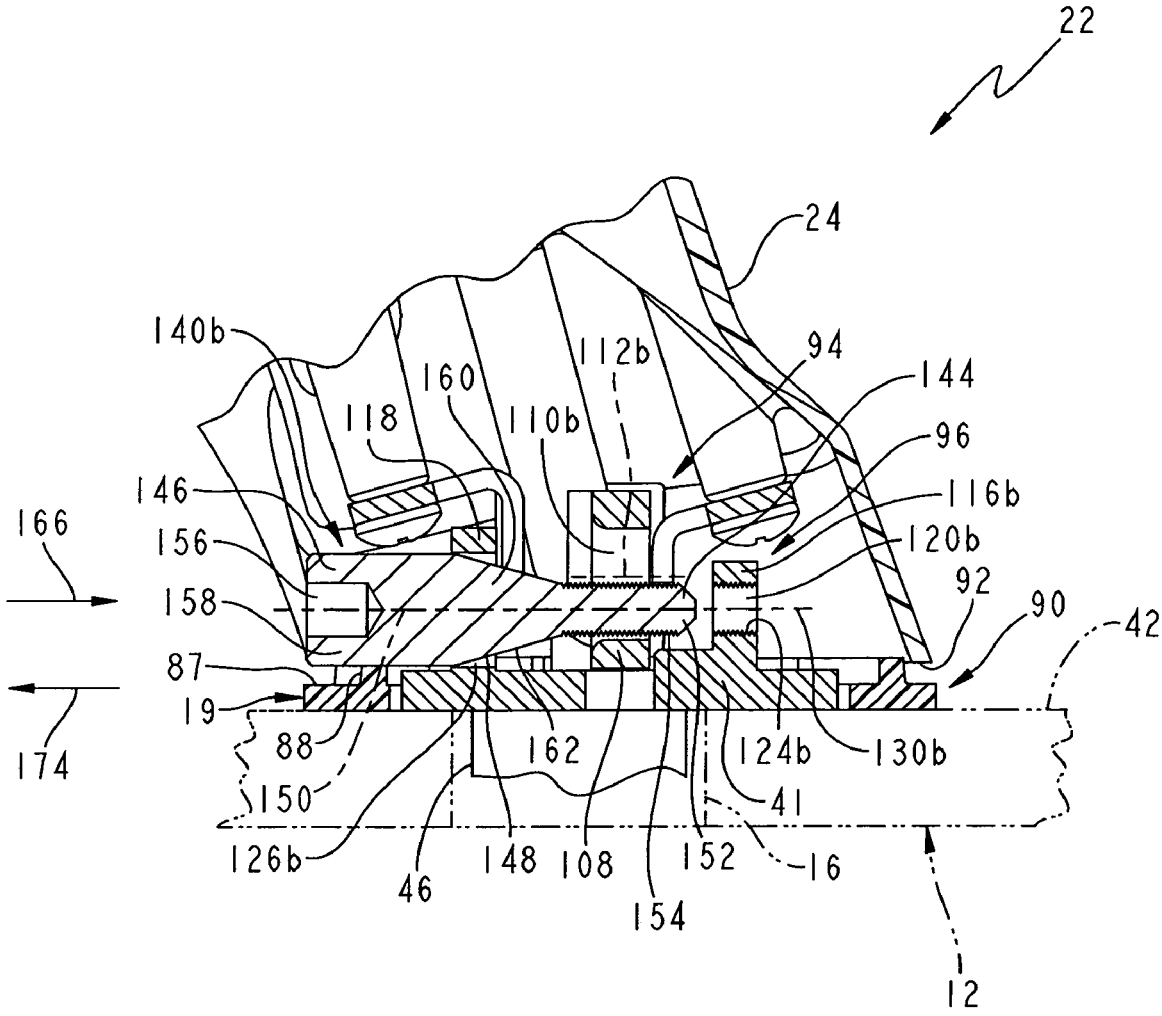
FIG. 3 is a cross-sectional view taken along line 3-3 of FIG. 1, showing a cam bolt partially inserted into the mounting base bracket.
Figure 4:
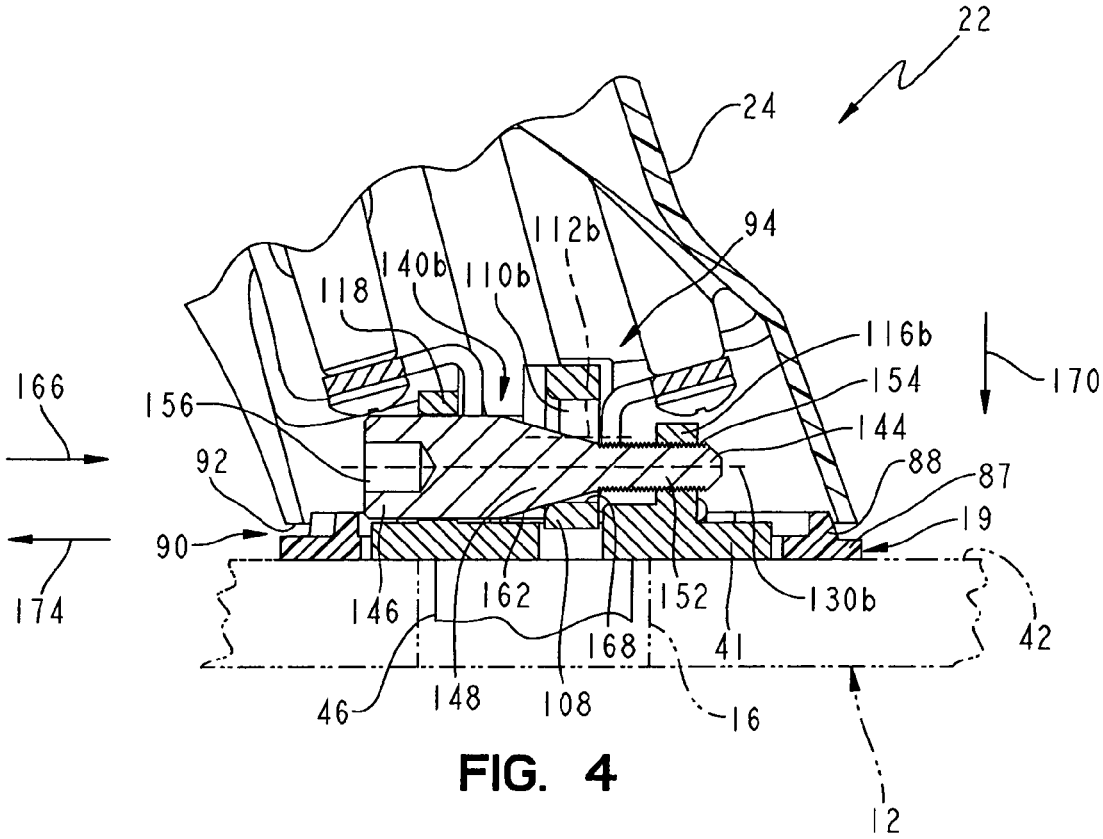
FIG. 4 is a cross-sectional view similar to FIG. 3, showing the cam bolt further inserted into the mounting base bracket and threadably engaging the securing member thereof, the cam portion of the cam bolt engaging the housing bracket.
Figure 5:
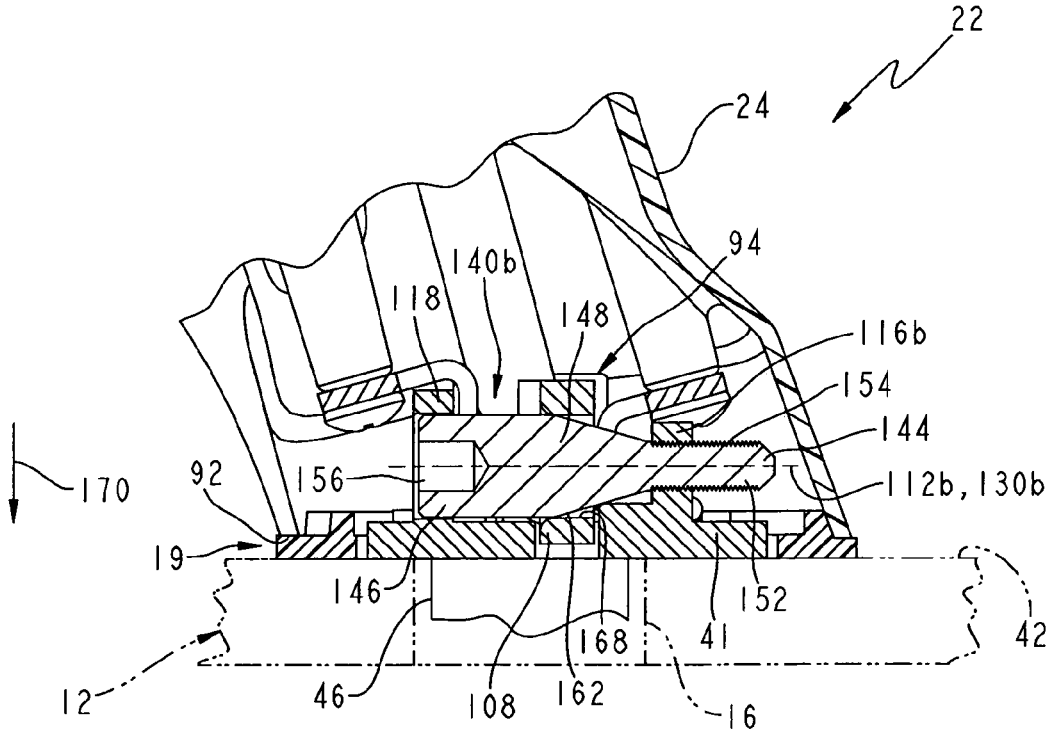
FIG. 5 is a cross-sectional view similar to FIG. 4, showing the cam bolt further inserted into the mounting base bracket and threadably engaging the securing member, the cam portion of the cam bolt further engaging the housing bracket and forcing the faucet body housing downwardly toward the mounting base.

With further reference to FIGS. 3-5, in order to install the faucet body housing 22 onto the mounting base 18, the faucet body housing 22 is lowered so that the receiving member 105 of the housing bracket 94 is positioned intermediate the securing members 116*a*, 116*b* and the alignment member 118 of the base bracket 96. The cam bolts 140*a*, 140*b* are then inserted through the respective openings 126*a*, 126*b* of the base bracket 96 and openings 110*a*, 110*b* of the housing bracket 94. Next, each cam bolt 140*a*, 140*b* is threadably received within the opening 120*a*, 120*b* of respective securing member 116*a*, 116*b* and rotated in a clockwise direction (as shown by arrow 164 in FIG. 2), illustratively through the use of a tool (not shown) inserted into the recess 156 of the operating end 158 of the cam bolt 140*a*, 140*b*. As such, the axes 150*a* and 150*b* of the cam bolts 140*a* and 140*b* are substantially coaxially aligned with the axes 130*a* and 130*b*, respectively, of the securing members 116*a* and 116*b* and the alignment member 118.

In response to the clockwise rotation, the cam bolt 140*a*, 140*b* moves axially in a direction from the housing bracket 94 to the securing member 116*a*, 116*b* (as shown by arrow 166 in FIGS. 2-4). As shown in FIG. 4, this axial movement causes similar movement of the frusto-conical portion 160 thereby causing the inclined outer surface 162 to contact a bearing surface 168 of the respective opening 110*a*, 110*b* of the housing bracket 94.

Figure 11:
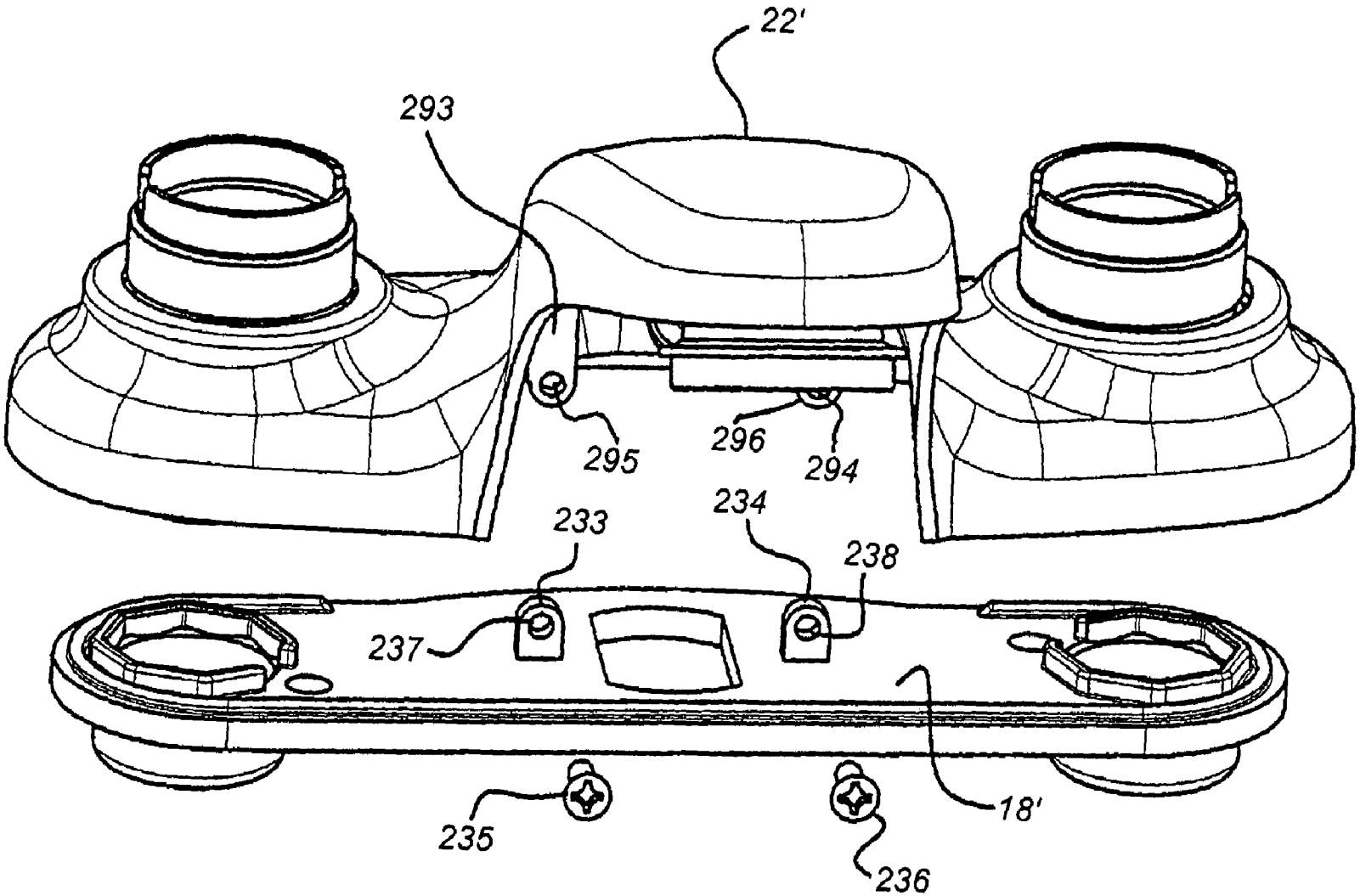
FIG. 11 illustrates an alternate embodiment for connecting the faucet body housing to the mounting plate, specifically by fastening means such as screws.

In one embodiment, as illustrated in FIG. 11, the faucet body housing 22' is attached to mounting plate 18' by fastening members 235, 236 such as screws or bolts which pass through aligned openings 295, 296, 237, 238 in raised ears 293, 294, 233, 234.

As shown in FIG. 5, continued clockwise rotation of the cam bolt 140*a*, 140*b* causes the inclined outer surface 162 to exert a downward force against the bearing surface 168 so that the body housing 22 is moved downwardly against the gasket 19 (as shown by arrow 170 in FIGS. 4 and 5), illustratively forming a watertight seal between the body housing 22 and the mounting deck 12. In other words, the axial movement of the cam bolt 140*a*, 140*b* causes the openings 110*a*, 110*b* of the housing bracket 94 to move into substantial coaxial alignment with the apertures 120*a*, 120*b* and 126*a*, 126*b* of the base bracket 96. More particularly, the axes 112*a*, 112*b* of the receiving member 105 (FIG. 6) are moved into substantial coaxial alignment with the axes 130*a*, 130*b* of the securing members 116*a*, 116*b* and the alignment member 118. As such, the lower edge 92 of the body housing 22 is forced against the base 87 of the gasket 19 to form a seal between the lower edge 92 and the top surface 42 of the mounting deck 12. In order to remove the housing body 22 from mounting base 18, the above-described process is reversed. More particularly, the user inserts a tool (not shown) into the recess 156 of the operating end 158 of each cam bolt 140*a*, 140*b* and rotates in a counterclockwise direction (as shown by arrow 172 in FIG. 2). In response to the counterclockwise rotation, the cam bolt 140*a*, 140*b* moves axially in a direction from the securing member 116*a*, 116*b* to the housing bracket 94 (as shown by arrow 174 in FIGS. 2-4). In this manner the cam bolts 140*a*, 140*b* are removed, thereby allowing the body housing 22 to be lifted away from the mounting base 18.

Although the invention has been described in detail with reference to certain preferred embodiments, variations and modifications exist within the spirit and scope of the invention as described and defined in the following claims.

The invention claimed is:

1. A faucet assembly comprising:

a mounting base configured to be coupled to a mounting deck and including first and second fluid conduits extending downwardly away from the mounting deck;

a waterway in fluid communication with the first and second fluid conduits of the mounting base;

a faucet body housing configured to be positioned above the waterway;

a gasket positioned above the mounting deck and configured to engage the faucet body housing; and a coupler releasably coupling the faucet body housing to the mounting base, the coupler positioned above the mounting base and being configured to adjust downward force applied by the faucet body housing against the gasket.

2. The faucet assembly of claim 1, wherein the mounting base includes:

a base plate, the first and second fluid conduits being in fluid communication with openings formed in the base plate;

a first attachment post positioned adjacent the first fluid conduit;

a second attachment post positioned adjacent the second fluid conduit;

a first mounting base locking member operably coupled to the first attachment post;

a second mounting base locking member operably coupled to the second attachment post; and wherein the first and second fluid conduits are configured to be coupled to fluid supply lines for supplying fluid to the waterway.

3. The faucet assembly of claim 2, wherein the first attachment post and the second attachment post each include external threads, a first securing nut associated with the first mounting base locking member and threadably receiving the first attachment post, and a second securing nut associated with the second mounting base locking member and threadably receiving the second attachment post, so that rotational movement between the first and second securing nuts and the first and second attachment posts causes the securing nuts to move axially along the first and second attachment posts, thereby causing the locking members to engage the under surface of the mounting deck for securing the mounting base to the mounting deck.

4. The faucet assembly of claim 1, wherein the coupler comprises a cam bolt including an attachment portion and a cam portion.

5. The faucet assembly of claim 4, further comprising:

a securing member coupled to the mounting base;

a housing bracket coupled to one of the faucet body housing and the waterway;

wherein the attachment portion of the cam bolt is coupled to the securing member and the cam portion of the cam bolt is configured to engage the housing bracket and apply the downward force to the faucet body housing.

6. The faucet assembly of claim 5, wherein:

the securing member includes a threaded aperture configured to receive the attachment portion of the cam bolt;

the housing bracket includes an opening configured to receive the cam portion of the cam bolt; and the cam portion of the cam bolt includes a frusto-conical portion configured to engage the housing bracket and force the opening of the housing bracket into substantial coaxial alignment with the opening of the securing member.

7. The faucet assembly of claim 5, further comprising an alignment bracket including an opening configured to receive the cam bolt and coaxially aligned with the opening of the securing member, the housing bracket being positioned intermediate the alignment bracket and the securing member.

8. A faucet assembly comprising:

a mounting base configured to be coupled to a mounting deck;

a faucet body housing configured to be positioned above the mounting base;

a securing member supported by the mounting base;

a housing bracket supported by the faucet body housing;

a coupler releasably coupling the faucet body housing to the mounting base, the coupler including a cam bolt having an attachment portion configured to be received within the securing member and a frusto-conical portion configured to be received within the housing bracket; and wherein the frusto-conical portion of the cam bolt is configured to cause the faucet body housing to move toward the mounting base as the cam bolt is moved axially in a direction from the housing bracket toward the securing member.

9. The faucet assembly of claim 8, wherein the mounting base includes first and second fluid conduits extending downwardly from the mounting deck.

10. The faucet assembly of claim 9, further comprising a waterway coupled to the faucet body housing and including first and second fluid tubes in fluid communication with the first and second fluid conduits of the mounting base, the housing bracket being coupled to the waterway.

11. The faucet assembly of claim 10, wherein the mounting base includes:

a base plate, the first and second fluid conduits being in fluid communication with openings formed in the base plate;

a first attachment post positioned adjacent the first fluid conduit;

a second attachment post positioned adjacent the second fluid conduit;

a first mounting base locking member operably coupled to the first attachment post;

a second mounting base locking member operably coupled to the second attachment post; and wherein the first and second fluid conduits are configured to be coupled to fluid supply lines for supplying fluid to the waterway.

12. The faucet assembly of claim 8, further comprising a gasket positioned above the mounting deck and configured to engage the faucet body.

13. The faucet assembly of claim 8, wherein:

the securing member includes a threaded aperture configured to receive the attachment portion of the cam bolt;

the housing bracket includes an opening configured to receive the frusto-conical portion of the cam bolt; and the frusto-conical portion of the cam bolt is configured to engage the housing bracket and force the opening of the housing bracket into substantial coaxial alignment with the opening of the securing member.

14. The faucet assembly of claim 13, further comprising an alignment bracket including an opening configured to receive the cam bolt and coaxially aligned with the threaded aperture of the securing member, the housing bracket being positioned intermediate the alignment bracket and the securing member.

15. A faucet assembly comprising:

a mounting base configured to be coupled to a mounting deck and including first and second fluid conduits extending downwardly from the mounting deck;

a waterway including first and second fluid tubes removably received within, and in fluid communication with, the first and second fluid conduits of the mounting base;

a faucet body housing configured to be positioned above the waterway;

a gasket positioned above the mounting deck and configured to engage the faucet body housing; and a cam mechanism configured to couple the faucet body housing to the mounting base, wherein operation of the cam mechanism moves the faucet body housing toward the mounting base.

16. The faucet assembly of claim 15, wherein the mounting base includes:

a base plate, the first and second fluid conduits being in fluid communication with openings formed in the base plate;

a first attachment post positioned adjacent the first fluid conduit;

a second attachment post positioned adjacent the second fluid conduit;

a first mounting base locking member operably coupled to the first attachment post;

a second mounting base locking member operably coupled to the second attachment post; and wherein the first and second fluid conduits are configured to be coupled to fluid supply lines for supplying fluid to the waterway.

17. The faucet assembly of claim 15, wherein the cam mechanism comprises a cam bolt including an attachment portion and a cam portion.

18. The faucet assembly of claim 17, further comprising:

a securing member coupled to the mounting base;

a housing bracket coupled to one of the faucet body housing and the waterway;

wherein the attachment portion of the cam bolt is coupled to the securing member and the cam portion of the cam bolt is configured to engage the housing bracket and apply the downward force to the faucet body housing.

19. The faucet assembly of claim 18, wherein:

the securing member includes a threaded aperture configured to receive the attachment portion of the cam bolt;

the housing bracket includes an opening configured to receive the cam portion of the cam bolt; and the cam portion of the cam bolt includes a frusto-conical portion configured to engage the housing bracket and force the opening of the housing bracket into substantial coaxial alignment with the opening of the securing member.

20. The faucet assembly of claim 17, further comprising an alignment bracket including an opening configured to receive the cam bolt and coaxially aligned with the opening of the securing member, the housing bracket being positioned intermediate the alignment bracket and the securing member.

21. A locking mechanism for a faucet assembly, the locking mechanism comprising:

a securing member including an opening having internal threads;

a first bracket including an opening and positioned in spaced relation to the securing member;

a cam bolt including an attachment portion having external threads configured to be threadably received within the opening of the securing member, the cam bolt further including a frusto-conical portion configured to be received within the opening of the first bracket; and wherein rotational movement of the attachment portion of the cam bolt causes axial movement of the frusto-conical portion of the cam bolt into engagement with the first bracket, thereby forcing the opening of the first bracket into substantial coaxial alignment with the opening of the securing member.

22. The locking mechanism of claim 21, further comprising a second bracket including an opening configured to receive the cam bolt and coaxially aligned with the opening of the securing member, the first bracket being positioned intermediate the second bracket and the securing member.

23. A faucet assembly comprising:

a mounting base configured to be coupled to a mounting deck and supporting an opening, the mounting base including first and second fluid conduits extending downwardly from the mounting deck;

a waterway fluidly and releasably coupled with the first and second fluid conduits of the mounting base;

a faucet body housing configured to be positioned above the mounting base and supporting an opening; and a fastener configured to be received within the opening of the mounting base and the opening of the faucet body housing, thereby securing the faucet body housing to the mounting base.

24. The faucet assembly of claim 23, wherein the fastener includes a plurality of threads.

25. The faucet assembly of claim 23, further comprising:

a securing member extending upwardly from the mounting base and including the opening supported by the mounting base; and a housing bracket extending downwardly from the faucet body housing and including the opening supported by the faucet body housing.

26. The faucet assembly of claim 25, wherein the fastener includes a cam bolt having an attachment portion configured to be received within the opening of the securing member and a frusto-conical portion configured to be received within the opening of the housing bracket.

27. The faucet assembly of claim 26, wherein the frusto-conical portion of the cam bolt is configured to cause the faucet body housing to move toward the mounting base as the cam bolt is moved axially in a direction from the housing bracket toward the securing member.

* * * * *